United States Patent [19]

Hopkins

[11] Patent Number: 4,464,804

[45] Date of Patent: Aug. 14, 1984

[54] HANDHELD SWEEPER

[75] Inventor: Ross E. Hopkins, Emporia, Kans.

[73] Assignee: Hopkins Manufacturing Corporation, Emporia, Kans.

[21] Appl. No.: 414,410

[22] Filed: Sep. 2, 1982

[51] Int. Cl.[3] ..... A47L 11/33

[52] U.S. Cl. ..... 15/42; 15/27; 15/41 R

[58] Field of Search ..... 15/41–48, 15/27

[56] References Cited

U.S. PATENT DOCUMENTS

| | | | |
|---|---|---|---|
| 1,402,343 | 1/1922 | Doland | 15/41 R |
| 1,612,529 | 12/1926 | Nurenberg | 15/41 R |
| 3,594,841 | 7/1971 | Kleves | 15/4 |
| 3,618,153 | 11/1971 | Coult | 15/41 |
| 3,651,529 | 3/1972 | Popeil | 15/4 |
| 3,671,991 | 6/1972 | Fukuba | 15/41 |
| 3,924,285 | 12/1975 | Hukuba | 15/41 R |

*Primary Examiner*—Edward L. Roberts
*Attorney, Agent, or Firm*—Lahive & Cockfield

[57] ABSTRACT

A handheld sweeper with a rotary brush and compartments for collecting debris has a rear door pivotally mounted to close a rear opening of the compartment. A front button operates a plate terminating with a hinge-like web connected to the door to open and close the door. A biasing spring biases the door closed. An auxiliary brush in front of the sweeper is located below the button.

6 Claims, 4 Drawing Figures

HANDHELD SWEEPER

BACKGROUND

This invention relates generally to handheld sweepers and particularly to a handheld sweeper with a convenient system for disposal of debris accumulated in the sweeper.

A common and useful household device that has been used in many forms over the years is the handheld sweeper. The device typically consists of a housing and a cylindrical rotating brush projecting through an aperture in the bottom of the housing. Moving the device back and forth over a debris loaded surface causes the debris to be swept by the brush into the interior of the housing. U.S. Pat. No. 3,651,529 to Popeil is one example of such a sweeper. In some forms the sweepers have auxiliary brushes attached to the exterior of the sweeper housing (e.g., U.S. Pat. No. 3,618,153 to Coult, and U.S. Pat. No. 3,594,841 to Kreves). All forms of sweepers must have some means for discharging the debris collected in the sweeper housing. U.S. Pat. No. 3,671,991 to Fukuba provides a door at one end of the sweeper for that purpose. U.S. Pat. No. 1,402,343 to Doland has bottom panels that drop open when the housing is squeezed by hand. Despite the number of such devices over the years, improvements in the form of handheld sweepers are still possible and desirable, particularly in the mechanism for discharging debris.

It is an object of the invention to provide a new and improved handheld sweeper that is easy to use and manufacture. It is a further object to provide such a sweeper that can discharge accumulated debris easily and conveniently. It is a further object still to provide such a sweeper that combines a number of auxiliary functions, such as additional brushes and discharge mechanisms, in handy and efficient modes of operation.

SUMMARY OF THE INVENTION

The invention comprises a handheld sweeper comprising a housing grippable by hand, the housing defining a bottom aperture, a rotary brush mounted for rotation about an axis in housing, a portion of the brush extending through the aperture to sweep debris from a surface into the housing, the housing further defining a compartment for collecting debris swept into the housing and an opening at the end of the housing communicating with the compartment for the discharge of collected debris. The invention includes also a door means for closing the opening, the door means being adapted to be movable away from the opening, operating means operable to move the door means away from closing the opening, and control means for controlling the operating means, the control means being remote from the door means.

In a preferred embodiment, the invention includes the control means being located at an end of the housing opposite the door means, biasing means for biasing the door means to close the opening, the control means having a finger-operated pushable surface, and an external brush mounted on the end of the housing opposite the door means, and below the finger-operated pushable surface. Also the door means may be adapted to be pivotable about an edge, the operating means may be pivotally connected to the door means to open it, and the control means may be on the operating means to move the operating means.

BRIEF DESCRIPTION OF THE DRAWING

Other objects, features and advantages of the invention will be apparent in, or will be disclosed specifically in, the following description of a preferred embodiment of the invention, including the drawings thereof, in which.

DESCRIPTION OF A PREFERRED EMBODIMENT

Figure 1:
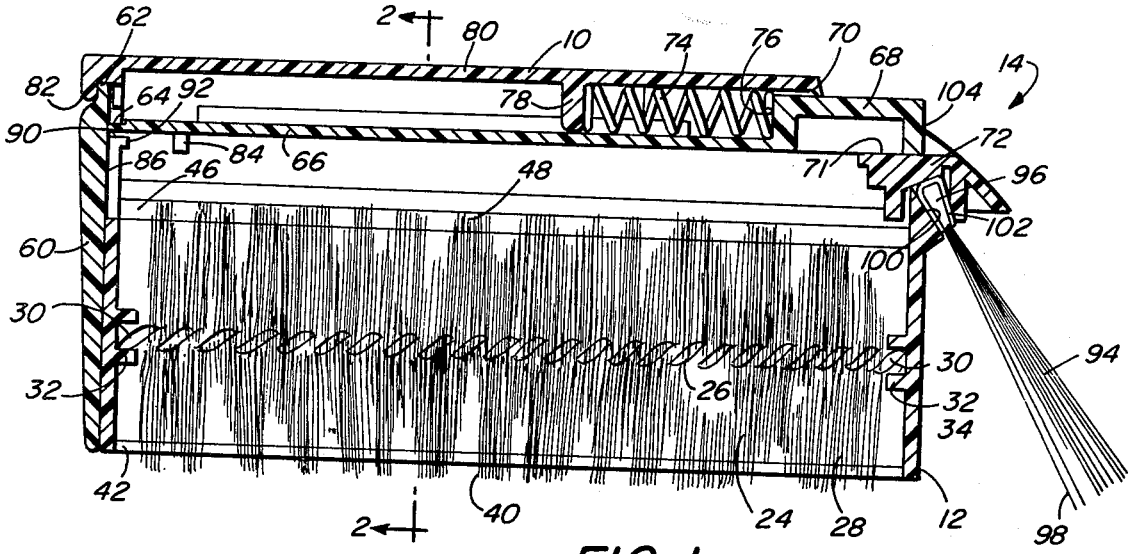
FIG. 1 is a sectional view of a handheld sweeper embodying the invention.
Figure 2:
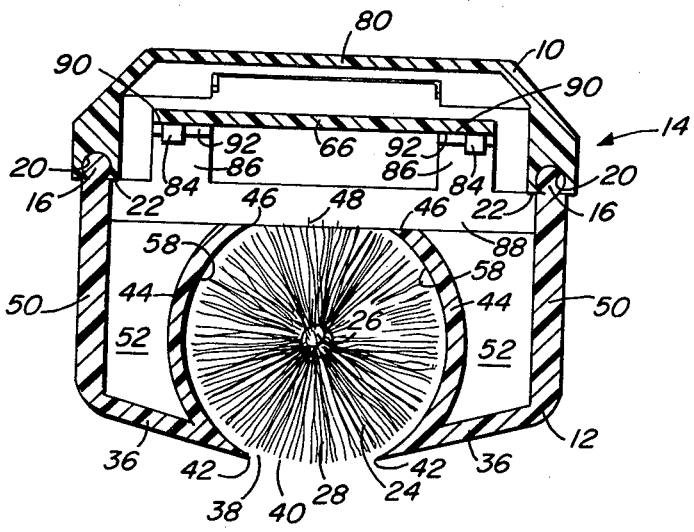
FIG. 2 is a cross-sectional view of the sweeper of FIG. 1.
Figure 3:
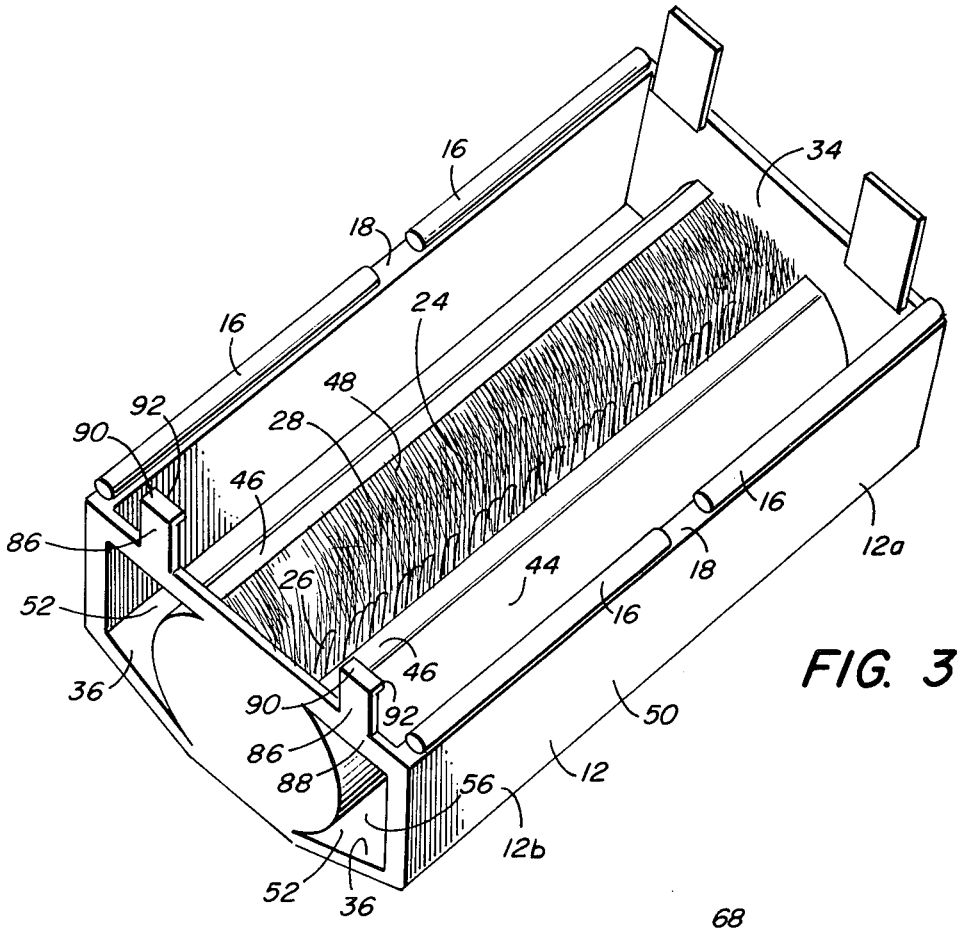
FIG. 3 is a perspective view of the bottom section of the sweeper.
Figure 4:
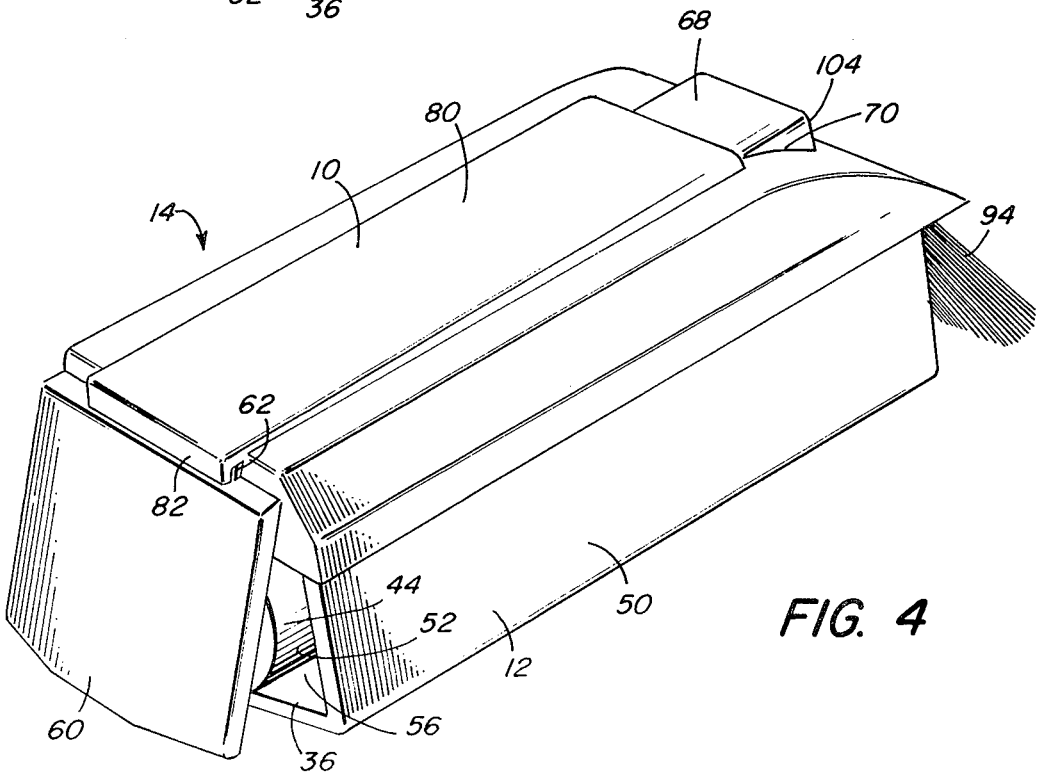
FIG. 4 is a perspective view of the sweeper, showing the debris discharge door in the open position.

The handheld sweeper as shown in FIGS. 1, 2 and 4 has top 10 and bottom 12 housing portions made from molded plastic. Together the portions 10,12 form a housing 14 for the sweeper that is sized to be conveniently held by the hand. The portions 10,12 are snap fit together by mating cylindrical ribs 16 atop the upper edges 18 of the bottom portion 12 with appropriately shaped grooves 20 formed by the bottom edges 22 of the upper portion 10.

A longitudinal cylindrical bristle brush 24 extends across the housing bottom portion 12. The brush 24 has a spirally wound wire core 26 grasping the bases of numerous radially extending bristles 28 in a conventional manner well known in the art. Each end 30 of the wire core 26 is seated in a bearing 32 molded in the interior and walls 34 of the bottom portion 12, so that the brush 24 is free to rotate about the axis formed by the wire core 26. The housing bottom portion 12 is furthermore divided into a front section **12*a* and a back section 12*b*** that are glued together to form the bottom portion.

The bottom portion 12 includes a bottom wall 36 with a central longitudinal aperture 38 through which the outer portions 40 of the brush bristles 28 extend. Extending upwardly from the edges 42 of the bottom wall 36 adjacent the aperture 38, and around the periphery of the brush 24, are curvilinear compartment walls 44. The walls 44 extend around the periphery of the brush 24 to upper edges 46 just below the top portions 48 of the brush bristles 28. The compartment walls 44, and the bottom walls 36 and the side walls 50 of the housing 14, form debris collecting compartments 52 extending the length of the device on either side of the brush 24.

At the forward end of the compartments 52, the compartments are closed by the end wall 34. At the rear end of the compartments 52, there are openings 56 through which debris collected in the compartments 52 may be discarded. The debris is collected in the compartments 52 by the conventional action of the brush 24. That is, as the device is moved, from side to side, pressed down on a surface, debris on the surface is swept up along the inside surfaces 58 of the curvilinear compartment walls 44 by the brush and over the upper edges 46 of the walls 44 into the compartments 52.

The top housing portion 10 completes the enclosure of the device. A door 60 extends down from the rear of the top housing portion 10 to close the openings 56 of the debris collecting compartments 52. Near the upper edge 62 of the door 60, but a slight distance below the edge, the inside of the door is connected by a thin web 64 of plastic material to a door operating plate 66 extending horizontally within the housing toward the front of the top housing portion 10. The plate 66 terminates in a rectangular control button 68 that protrudes through an opening 70 in the front of the top housing portion 10.

The button 68 is slidable on the upper surface 71 of a front auxiliary brush holding section 72 formed at the front of the top housing portion 10. A metal coiled spring 74 extends from a rear surface 76 of the button 68 to a short wall 78 extending down from the top housing portion upper wall 80, biasing the button 68 and the attached plate 66 in the forward direction. The most forward portion of the button 68 (see FIG. 1) is established by the door 60 in the closed position.

When the button 68 is pushed rearward against the biasing force of the spring 74, it causes the door 60 to pivot about the door's narrow upper edge 62, captured behind an overhanging lip 82 formed by the top housing portion 10. The web 64 is flexible enough to allow the door 60 to pivot outwardly (see FIG. 4).

The rearmost position of the button 68 and plate 66 is determined by the stops 84 extending downwardly from the plate 66 a short distance from the web 64. The stops 84 are aligned with two tabs 86 extending upwardly from an end top wall 88 at the rear of the bottom housing portion 12. The upper surfaces 90 of the tabs 86 provide a support on which the rear of the plate 66 is slidable, and the forward surfaces 92 of the tabs provide a stop against which the two stops 84 abut when the button 68 is pressed rearwardly a short distance.

An auxiliary brush 94 extends diagonally downwardly and forwardly from the brush holding section 72 at the front of the device and below the button 68. The brush 94 has a metal clip 96 fastening the ends of bristles 98. The clip 96 is captured between an angled surface 100 formed by the top of the bottom housing portion end wall 34, and another surface 102 formed by the brush holding section 72 of the top housing portion 10.

In operation, then, the device is grasped by the hand and is moved across a surface from side to side to sweep debris on the surface up and into the debris collecting compartments 52. The auxiliary brush 94 at the front of the device provides a handy means for sweeping debris from corners inaccessible to the sweeping motion to locations where the debris can be picked up by the device's sweeping motion.

During this operation of the device, the door 60 at the rear of the device is biased in the closed position, covering the debris compartment rear openings 56. When the debris is to be discarded, the operator presses a finger on the front surface 104 of the button 68, pushing it rearwardly. The movement rearwardly of the button 68 is transmitted via the plate 66 and the web 64 to the door 60. The door 60 pivots open (see FIG. 4), the web 64 acting like a hinge. Debris in the compartments 52 then falls through the rear openings 56, provided, of course, that the device is tipped up at the forward end.

During this discharge of the debris, the hand of the user is shielded from the debris, and remains in the same position as when it was sweeping with the device, allowing the discharge to be accomplished smoothly, efficiently and neatly. This is because the operation of the door 60 is done from the remote position of the button 68, away from where the debris is discharged. Furthermore, when the button 68 is released, the door 60 automatically closes again, making the device usable for more sweeping without removing the hand from the device.

The position of the auxiliary brush 94 at the front of the device, where the hand is held ready to operate the button 68, is convenient. Having the hand near the auxiliary brush 94 allows the user to manipulate the brush surely and easily.

The exact configuration of the button 68 and its connection to the door 60 through the intermediate control plate 66 may of course be varied. Other modifications, additions, and deletions may be made on the preferred embodiment without departing from the spirit of the invention, which is defined by the following claims.

I claim:

1. A handheld sweeper comprising:

a housing grippable by hand, said housing defining a bottom aperture, a rotary brush mounted for rotation about an axis in said housing, a portion of said brush extending through said aperture to sweep debris from a surface into said housing, said housing further defining a compartment for collecting debris swept into said housing, and having an end defining an opening remote from said hand and communicating with said compartment for the discharge of collected debris, door means for closing said opening, said door means adapted to be movable away from closing said opening, operating means operable to move said door means away from closing said opening, and control means for controlling said operating means, said control means being remote from said door means and accessible to said hand while said hand grips said housing.

2. The sweeper of claim 1 wherein said control means has a finger-operated pushable surface.

3. The sweeper of claim 1 further including an external brush mounted on the end of said housing opposite said door means.

4. The sweeper of claim 3 wherein said control means has a finger-operated pushable surface located above said external brush.

5. A handheld sweeper comprising:

a housing grippable by hand, said housing defining a bottom aperture, a rotary brush mounted for rotation about an axis in said housing, a portion of said brush extending through said aperture to sweep debris from a surface into said housing, said housing further defining a compartment for collecting debris swept into said housing, and having an end defining an opening communicating with said compartment for the discharge of collected debris, door means for closing said opening, said door means adapted to be movable away from closing said opening, operating means operable to move said door means away from closing said opening, and control means for controlling said operating means, said control means being remote from said door means wherein said control means is located at an end of said housing opposite said door means.

6. A handheld sweeper comprising:

a housing grippable by hand,
said housing defining a bottom aperture,
a rotary brush mounted for rotation about an axis in said housing,
a portion of said brush extending through said aperture to sweep debris from a surface into said housing,
said housing further defining a compartment for collecting debris swept into said housing, and having an end defining an opening communicating with said compartment for the discharge of collected debris,
door means for closing said opening,
said door means having an edge and being adapted to be pivotable about said edge,
operating means pivotally connected to said door means to open said door means,
control means on said operating means for moving said operating means.

* * * * *